US005592876A

United States Patent [19]

Son

[11] Patent Number: 5,592,876

[45] Date of Patent: Jan. 14, 1997

[54] PRESSING APPARATUS FOR CRUSHING USED CARS

[75] Inventor: Jung N. Son, Daegu, Rep. of Korea

[73] Assignee: Kum Sung Press Machine Co., Ltd., Daegu, Rep. of Korea

[21] Appl. No.: 418,023

[22] Filed: Apr. 6, 1995

[51] Int. Cl.[6] ..... B30B 1/16; B30B 9/32

[52] U.S. Cl. ..... 100/272; 72/451; 100/286; 100/901

[58] Field of Search ..... 100/270–272, 100/286, 901; 72/451

[56] References Cited

U.S. PATENT DOCUMENTS

| | | | |
|---|---|---|---|
| 1,508,433 | 9/1924 | Woulf | 100/271 |
| 2,243,205 | 5/1941 | Hall | 100/272 |
| 3,520,252 | 7/1970 | Jureit et al. | 100/272 |
| 3,844,209 | 10/1974 | Allbritton | 100/272 |

FOREIGN PATENT DOCUMENTS

| | | | |
|---|---|---|---|
| 613229 | 8/1935 | Germany | 100/272 |
| 929693 | 6/1955 | Germany | 100/272 |
| 4013107 | 10/1991 | Germany | 100/272 |

*Primary Examiner*—Stephen F. Gerrity

[57] ABSTRACT

A pressing apparatus for compressing large articles into small articles which includes an upper plate and a lower base plate, a pressing plate disposed between the upper plate and the lower base plate, the pressing plate being suspended from the upper plate by a plurality of foldable link members which are pivotally connected to the upper plate and to the pressing plate at opposite sides, a piston-cylinder connecting at least some of the foldable link members disposed at opposite sides of the upper plate and pressing plate, and a device for operating the piston-cylinder, whereby the back and forth movement of the piston-cylinder causes the foldable link members to fold on themselves to a closed position or extend to an open position whereby the pressing plate is raised and lowered relative to the upper plate and the lower base plate.

23 Claims, 5 Drawing Sheets

PRESSING APPARATUS FOR CRUSHING USED CARS

BACKGROUND OF THE INVENTION

1. Field of the Invention

The present invention relates to a waste vehicle or waste car pressing apparatus used for compressing a vehicle to a much smaller, manageable and more particularly, to an improved waste vehicle pressing apparatus including a pressing plate which is raised and lowered by a plurality of lifting and lowering guide links attached to an upper plate of a frame, wherein a central one of the plurality of lifting and lowering links is articulated and connected by a link and then raised and lowered by the piston rod of a laterally disposed cylinder so that the pressing plate has a strong pressing force as a result of the lever function of the lifting and lowering links.

2. Description of Related Art

Various types of waste car pressing apparatus are known in the art. Generally such an apparatus includes a pressing plate suspended from an upper frame member by a cylinder whereby the pressing plate is lifted and lowered by a piston rod of the cylinder. Therefore, since the pressing force of the pressing plate is only as large as the pressure force of the cylinder, in order to obtain a larger pressure force, the capacity of the cylinder must be increased. In any event, an overload is frequently generated with respect to the cylinder and thus the pressing apparatus experiences a shortened life.

SUMMARY OF THE INVENTION

Accordingly, it is an object of the present invention to provide an improved pressing apparatus, which eliminates the above problems encountered with conventional pressing apparatus.

Another object of the present invention is to provide a waste car pressing apparatus including a piston rod and cylinder, which executes a horizontal piston movement for raising and lowering guide links attached to a pressing plate. The pressing plate is simultaneously raised and lowered by the folding and unfolding of the guide links. As a result, a waste car can be pressed to a thin thickness by the application of a high pressure on the pressing plate.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a waste car pressing apparatus including a frame, a pressing plate connected to a plurality of lifting and lowering links which are attached to the bottom surface of the frame, and additional lifting and lowering links connected to a pair of piston rods of cylinders for providing a strong pressing force through the lever function of the lifting and lowering links.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF PREFERRED EMBODIMENTS

Figure 1:
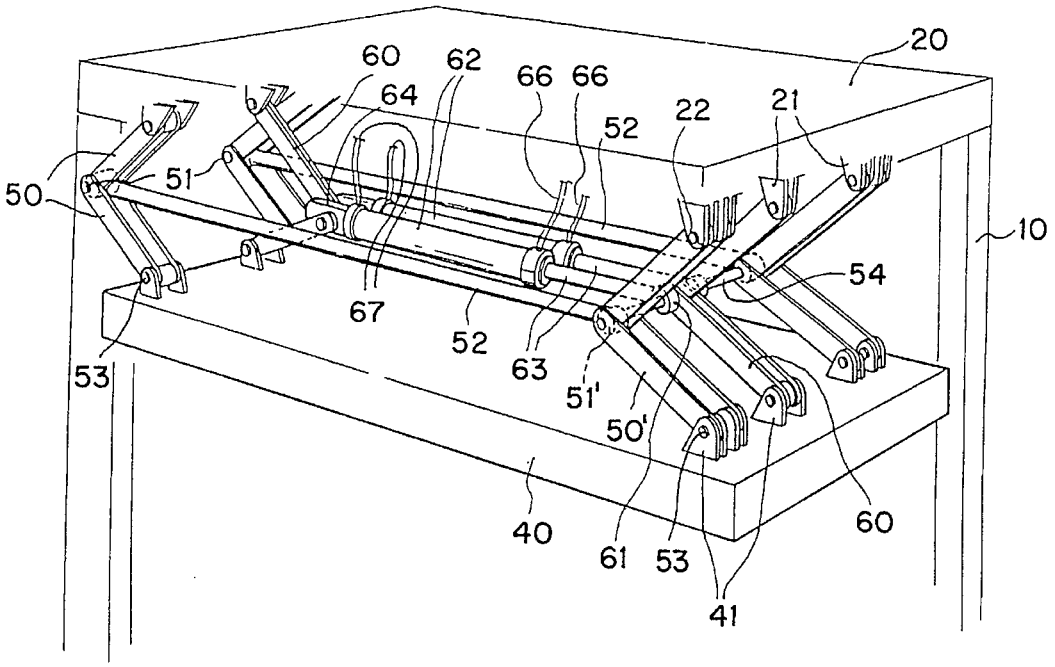
FIG. 1 is a perspective view showing a plurality of lifting and lowering links foldably connected to a pressing plate of a waste car pressing apparatus according to the present invention.
Figure 2:
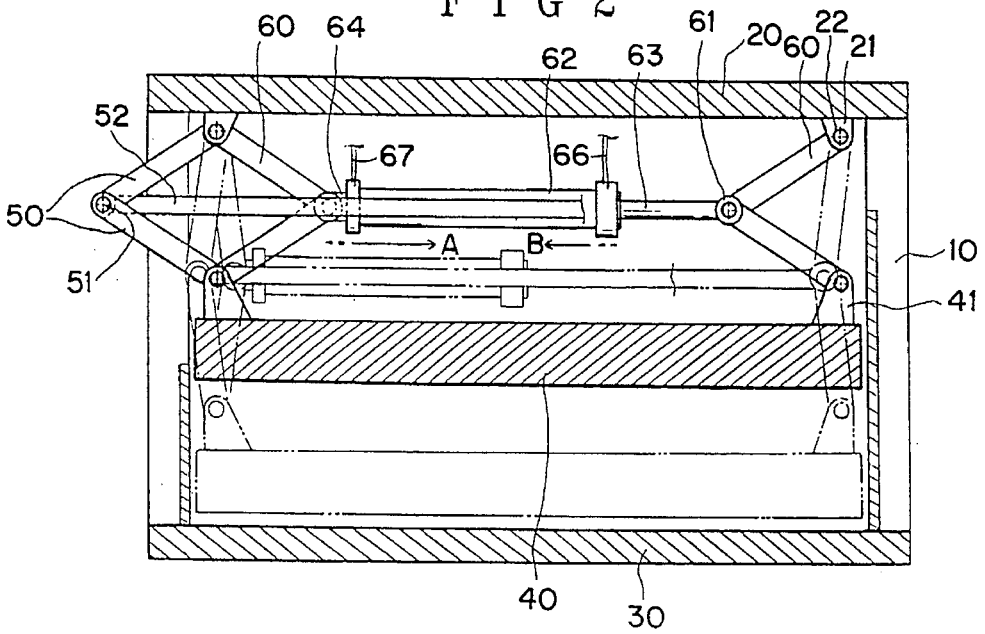
FIG. 2 is a sectional view of the waste car pressing apparatus according to the present invention showing the pressing plate in a raised and lowered position.
Figure 3:
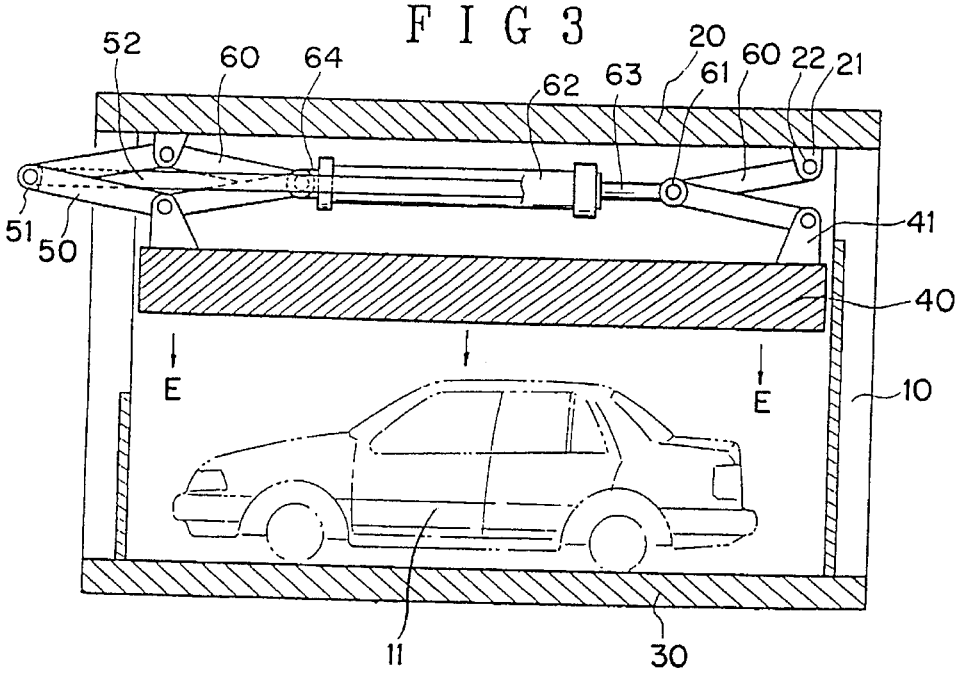
FIG. 3 is a sectional view of the waste car pressing apparatus according to the present invention showing the apparatus in an open position, that is, in a non-pressing state.

Referring now in detail to the drawings for the purpose of illustrating the preferred embodiments of the present invention, the waste car pressing apparatus as shown in FIGS. 1, 2, and 3, comprises a frame 10 having an upper plate 20 and a base plate 30.

A pressing plate 40 having a predetermined thickness is provided between the upper plate 20 and the base plate 30 where it is raised and lowered between said plates. A plurality of upper and lower fixed elements 21 and 41 extend from the bottom surface of the upper plate 20 and from the top surface of the pressing plate 40, respectively. Each fixed element 21 or 41 has a pivot pin hole 22 disposed therein.

Figure 5:
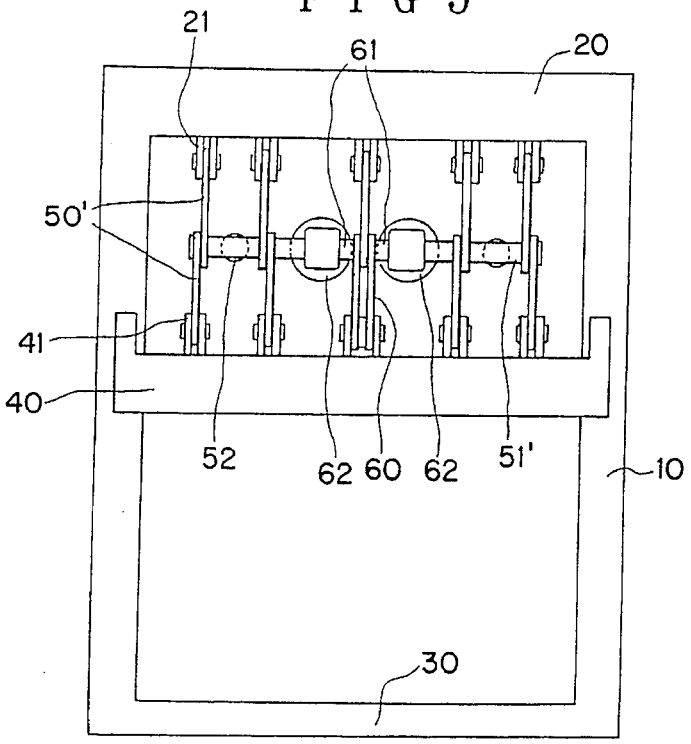
FIG. 5 diagrammatically shows the right side and the right side links of the waste car pressing apparatus according to the present invention.
Figure 6:
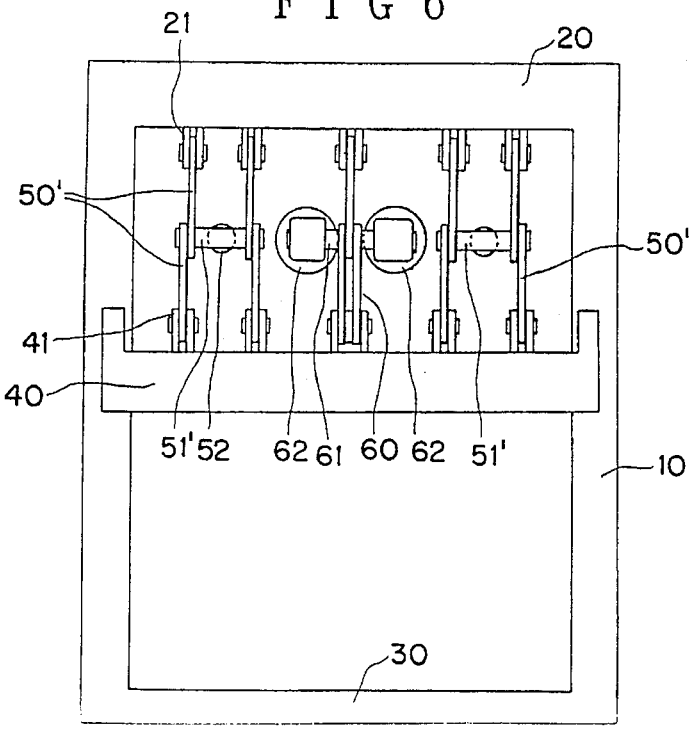
FIG. 6 diagrammatically shows the left side and the left side links of the waste car pressing apparatus according to the present invention.

As shown in FIGS. 1, 5, and 6, pairs of right and left supporting links 50 and 50' are pivotally engaged by pivot pins with the upper and lower fixed elements 21, 41 located at the four corners of both the bottom surface of the upper plate 20 and the top surface of the pressing plate 40. And two pairs of lifting and lowering links 60 are pivotally engaged by pivot pins 53 with the upper and lower fixed elements 21, 41 located at the center of the bottom surface of the upper plate 20 and at the center of the top surface of the pressing plate 40. Therefore, the lifting and lowering links 60 are disposed between the supporting links 50 and 50'.

The right and left supporting links 50 and 50' can be smoothly folded on themselves by a pair of right and left link joints 51 and 51'. And the lifting and lowering links 60 can be smoothly folded on themselves by a pair of second link joints 61. A pair of horizontal guide bars 52 are connected to the pair of right and left link joints 51 and 51', and a horizontal connecting bar 54 is connected to the piston rods 63 and horizontal guide bars 52 through link joints 51', whereby the right and left supporting links 50 and 50' maintain the same angle during operation.

The lifting and lowering links 60 are provided with the pair of second link joints 61 and a pair of cylinders 62. Each cylinder 62 is provided with a piston rod 63 connected to each second link joint 61 and is provided with each of a pair of connecting piece 64. Also, the cylinder 62 is provided with an oil port 67 and an oil port 66 for pumping and draining oil so as to move the piston rods 63 of the cylinders 62 forward and backward in accordance with a switch (not shown). The oil inlet/oil outlet valves are one-way valves, e.g. check valves.

The waste car pressing apparatus according to the present invention operates as follows. As shown in FIGS. 1 and 2, the upper plate 20 of the frame 10 and the pressing plate 40 are connected by the lifting and lowering links 60 and the supporting links 50 and 50' for lifting and lowering the pressing plate 40 so as to effectively press the waste car 11 onto the base plate 30 (FIG. 3).

As shown in FIGS. 2 and 3, in order to move from a closed, down state of the waste car pressing apparatus of the present invention as shown in broken lines in FIG. 2, to an open, raised state as shown in solid lines in FIG. 2, both cylinder 62 and piston rod 63 collapse in the direction indicated by arrows (A and B) from an extended position shown in broken lines in FIG. 2 to a collapsed position shown in solid lines in FIG. 3. During this time, oil is introduced into the oil port 66.

Figure 4:
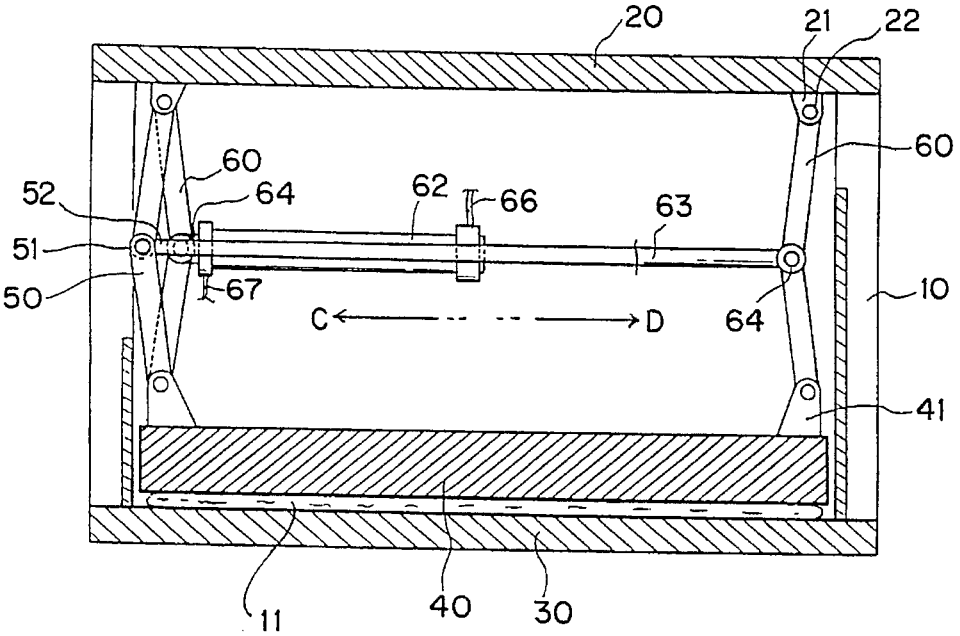
FIG. 4 is a sectional view of the waste car pressing apparatus according to the present invention showing the apparatus in a closed position, that is, in a pressing state.

When the waste car pressing apparatus is in an open position, the waste car 11 is put on the base plate 30 (FIG. 3). Thereafter, by compressing the oil pressure into the oil port 67, the cylinder 62 and the piston rod 63 both move in the direction indicated by the arrows C and D (FIG. 4) from the collapsed position shown in FIG. 3 to the fully extended position as shown in FIG. 4.

At this time, the pair of horizontal guide bars 52 operate to form the same angle with the right and left supporting links 50 and 50', and the lifting and lowering links 60 so that the pressing plate 40 presses in the direction indicated by arrows E as shown in FIG. 3. Accordingly, the waste car is effectively crushed as shown in FIG. 4.

As shown in FIGS. 5 and 6, the pair of lifting and lowering links 60 are provided with a pair of second link joints 61 disposed outside the pair of lifting and lowering links 60. The pair of second link joints 61 are connected to the pair of piston rods 63 disposed within the cylinders 62, respectively, which are positioned substantially parallel to each other. Therefore, the pair of cylinders 62 containing piston rods 63 provide a powerful piston operation which prevents the horizontal guide bars 52 from shaking and maintains a proper balance between the horizontal guide bars 52.

Figure 7:
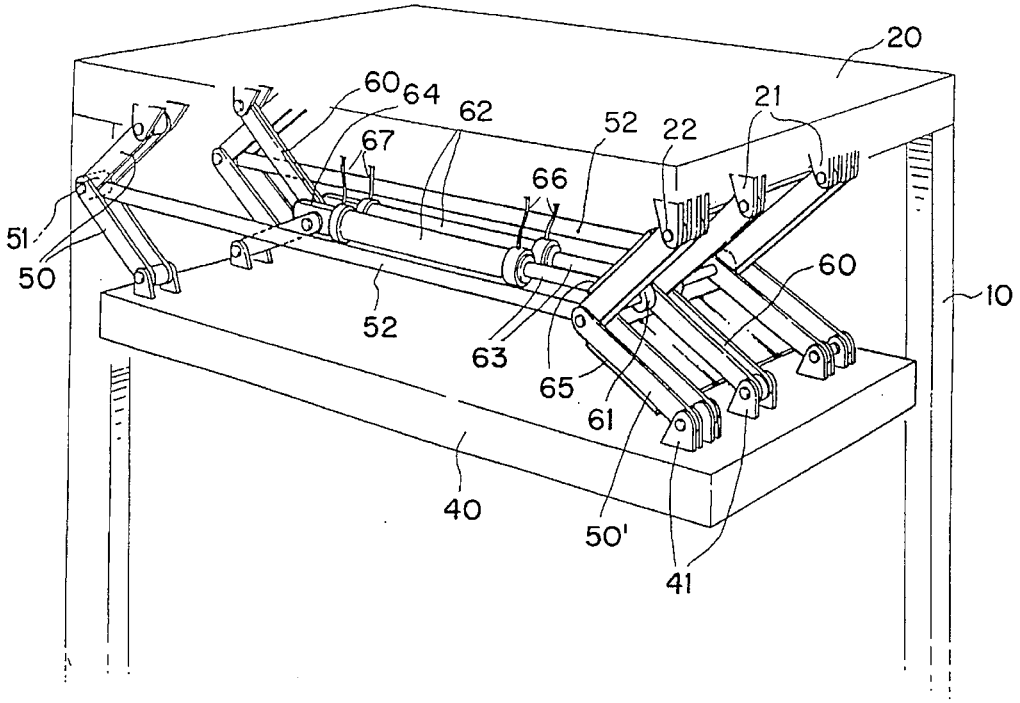
FIG. 7 is a perspective view showing a second embodiment according to the present invention.

Referring in detail to FIG. 7, there is illustrated a second embodiment of a waste car pressing apparatus in accordance with the present invention. The supporting links 50' and the adjacent lifting and lowering links 60 include an auxiliary plate 65 disposed on both outer surfaces thereon, respectively, so that the front and rear portions of the supporting links 50 and the lifting and lowering links 60 are made integral with each other and thus folded and expanded as a unit. This prevents shaking and/or rocking movements of the supporting links 50 and a uniform pressing operation of the pressing plate 40.

Figure 8:
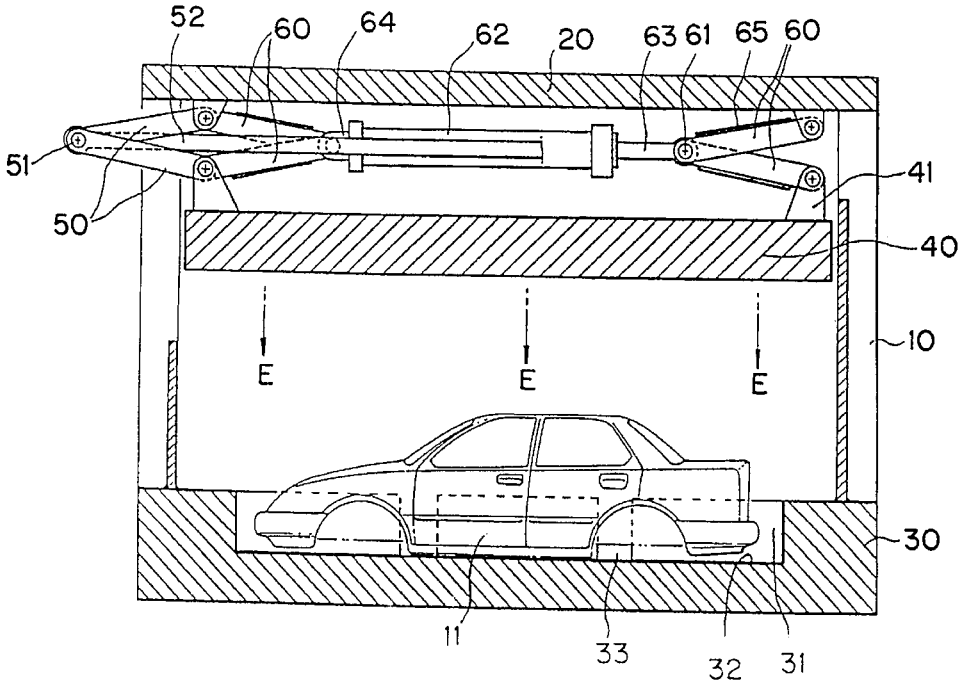
FIG. 8 is a sectional view of a third embodiment according to the present invention.
Figure 9:
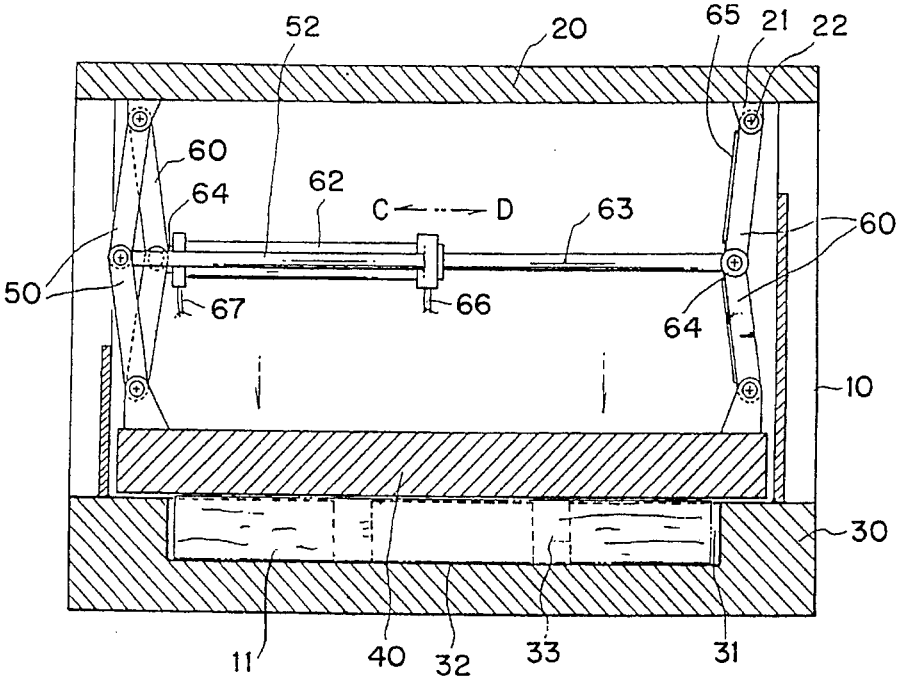
FIG. 9 is a sectional view of FIG. 8 showing the position of the pressing plate when it is lowered.
Figure 10:
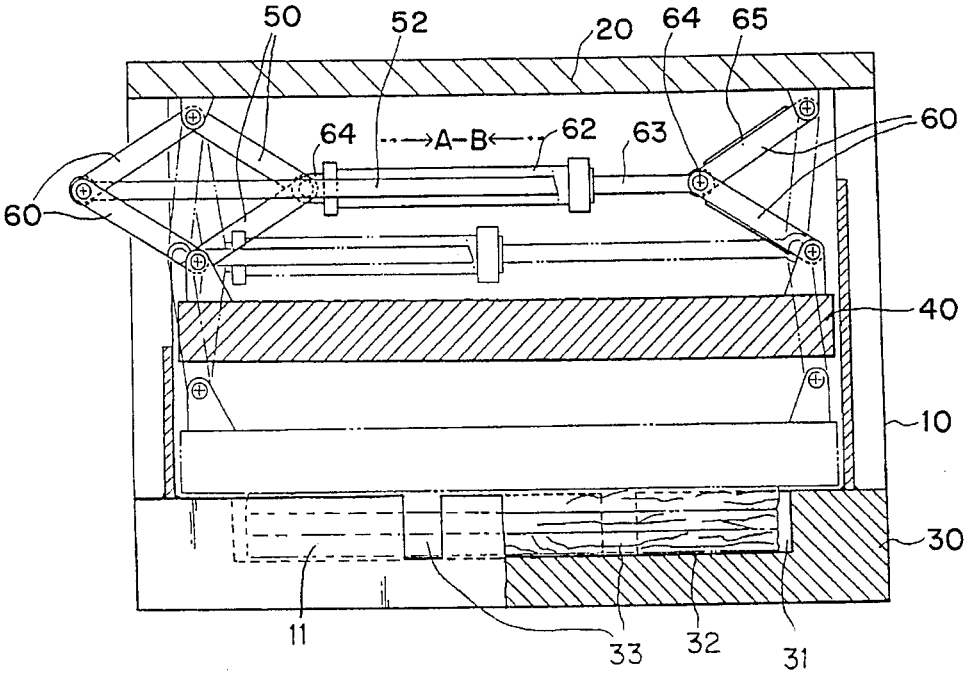
FIG. 10 is a sectional view of FIG. 8 showing where the waste cars are pressed in multiple stages in a pressing guide room.

FIGS. 8, 9, and 10 are sectional views illustrating a third embodiment of the waste care pressing apparatus in accordance with the present invention. The waste car pressing apparatus further includes a pressing guide room 31 formed on the top surface of the base plate 30 having a predetermined depth for pressing a waste car 11, placed on the bottom surface 32. Thereafter, another waste car 11 can be placed on top and thus, many waste cars can be pressed one car at a time. The pressing guide room 31 contains a pair of fork inserting grooves 33 for slidably receiving a pair of forks of a fork lift truck (not shown). Therefore, a predetermined number of waste cars can be pressed within the same pressing guide room 31 so that the labor can be reduced and the working operation can be simplified.

As described above, the multiple pressing is possible because the pressing plate 40 of the present invention is lifted and lowered by a folding and unfolding operation as a kind of lever operation whereby a strong pressing force is achieved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pressing apparatus for compressing large articles into small articles which comprises:

an upper plate and a lower base plate;

a pressing plate disposed between said upper plate and said lower base plate, said pressing plate being suspended from said upper plate by a plurality of foldable link members which are pivotally connected to the upper plate and to the pressing plate at opposite sides thereof;

piston-cylinder means connecting at least some of the foldable link members disposed at opposite sides of said upper plate and pressing plate; and means for operating said piston-cylinder means, whereby the back and forth movement of said piston-cylinder means causes said foldable link members to fold on themselves to a closed position or extend to an open position whereby the pressing plate is raised and lowered relative to said upper plate and said lower base plate;

wherein the foldable link members comprise central link members and lateral link members, said piston-cylinder means connecting said central link members, and wherein said pressing apparatus further includes horizontal bar members connecting said lateral link members.

2. The pressing apparatus of claim 1, wherein each of said foldable link members are also pivotally connected at their midpoint, and said piston-cylinder means connects with said central link members at their midpoint, whereby the operation of said piston-cylinder means causes the foldable link members to fold and unfold at their midpoints.

3. The pressing apparatus of claim 2, wherein said horizontal bar members connect with said lateral link members at a midpoint of said lateral link members.

4. The pressing apparatus of claim 1, wherein the foldable link members fold in the same direction.

5. The pressing apparatus of claim 1, wherein the piston-cylinder means extends substantially parallel to the pressing plate to connect with the foldable link members disposed at opposite sides of said upper plate and pressing plate.

6. The pressing apparatus of claim 1, wherein an auxiliary plate is attached to the foldable link members at least one side of the pressing apparatus.

7. The pressing apparatus of claim 1, wherein the top of the base plate is provided with a pressing guide room for receiving the article to be pressed.

8. The pressing apparatus of claim 7, wherein a floor of the pressing guide room is provided with slots for receiving a pair of forks from a fork lift truck.

9. The pressing apparatus of claim 1, wherein the means for operating the piston-cylinder means includes oil inlet means and oil outlet means for permitting pressurized oil to flow into and out of said piston-cylinder means.

10. A pressing apparatus for compressing large articles into small articles which comprises:

an upper plate and a lower base plate;

a pressing plate disposed between said upper plate and said lower base plate, said pressing plate being suspended from said upper plate by a plurality of foldable link members which are pivotally connected to the upper plate and to the pressing plate at opposite sides thereof;

piston-cylinder means connecting at least some of the foldable link members disposed at opposite sides of said upper plate and pressing plate; and means for operating said piston-cylinder means, whereby the back and forth movement of said piston-cylinder means causes said foldable link members to fold on themselves to a closed position or extend to an open position whereby the pressing plate is raised and lowered relative to said upper plate and said lower base plate; and wherein an auxiliary plate is attached to the foldable link members at at least one side of the pressing apparatus.

11. The pressing apparatus of claim 10, wherein the foldable link members comprise central link members and lateral link members, said piston-cylinder means connecting said central link members, and wherein said pressing apparatus further includes horizontal bar members connecting said lateral link members; and wherein each of said foldable link members are also pivotally connected at their midpoint, and said piston-cylinder means connects with said central link members at their midpoint, whereby the operation of said piston-cylinder means causes the foldable link members to fold and unfold at their midpoints.

12. The pressing apparatus of claim 11, wherein said horizontal bar members connect with said lateral link members at a midpoint of said lateral link members.

13. The pressing apparatus of claim 10, wherein the foldable link members fold in the same direction.

14. The pressing apparatus of claim 10, wherein the piston-cylinder means extends substantially parallel to the pressing plate to connect with the foldable link members disposed at opposite sides of said upper plate and pressing plate.

15. The pressing apparatus of claim 10, wherein the top of the base plate is provided with a pressing guide room for receiving the article to be pressed.

16. The pressing apparatus of claim 15, wherein a floor of the pressing guide room is provided with slots for receiving a pair of forks from a fork lift truck.

17. The pressing apparatus of claim 10, wherein the means for operating the piston-cylinder means includes oil inlet means and oil outlet means for permitting pressurized oil to flow into and out of said piston-cylinder means.

18. A pressing apparatus for compressing large articles into small articles which comprises:

an upper plate and a lower base plate;

a pressing plate disposed between said upper plate and said lower base plate, said pressing plate being suspended from said upper plate by a plurality of foldable link members which are pivotally connected to the upper plate and to the pressing plate at opposite sides thereof;

piston-cylinder means connecting at least some of the foldable link members disposed at opposite sides of said upper plate and pressing plate; and means for operating said piston-cylinder means, whereby the back and forth movement of said piston-cylinder means causes said foldable link members to fold on themselves to a closed position or extend to an open position whereby the pressing plate is raised and lowered relative to said upper plate and said lower base plate; and wherein the top of the base plate is provided with a pressing guide room for receiving the article to be pressed; and wherein a floor of the pressing guide room is provided with slots for receiving a pair of forks from a fork lift truck.

19. The pressing apparatus of claim 18, wherein the foldable link members comprise central link members and lateral link members, said piston-cylinder means connecting said central link members, and wherein said pressing apparatus further includes horizontal bar members connecting said lateral link members; and wherein each of said foldable link members are also pivotally connected at their midpoint, and said piston-cylinder means connects with said central link members at their midpoint, whereby the operation of said piston-cylinder means causes the foldable link members to fold and unfold at their midpoints.

20. The pressing apparatus of claim 19, wherein said horizontal bar members connect with said lateral link members at a midpoint of said lateral link members.

21. The pressing apparatus of claim 18, wherein the foldable link members fold in the same direction.

22. The pressing apparatus of claim 18, wherein the piston-cylinder means extends substantially parallel to the pressing plate to connect with the foldable link members disposed at opposite sides of said upper plate and pressing plate.

23. The pressing apparatus of claim 18, wherein the means for operating the piston-cylinder means includes oil inlet means and oil outlet means for permitting pressurized oil to flow into and out of said piston-cylinder means.

* * * * *